US005431589A

United States Patent [19]

Corona

[11] Patent Number: 5,431,589

[45] Date of Patent: Jul. 11, 1995

[54] SUBMERSIBLE MOORING BUOY

[75] Inventor: Emilio N. Corona, Farmers Branch, Tex.

[73] Assignee: Atlantic Richfield Company, Los Angeles, Calif.

[21] Appl. No.: 258,315

[22] Filed: Jun. 10, 1994

[51] Int. Cl.[6] ..... B63B 22/02

[52] U.S. Cl. ..... 441/4; 114/293

[58] Field of Search ..... 441/3-5; 114/293, 230, 264, 265, 144 B; 166/352-354

[56] References Cited

U.S. PATENT DOCUMENTS

| | | | |
|---|---|---|---|
| 3,080,583 | 3/1963 | Fuller | 441/4 |
| 3,722,223 | 3/1973 | Gratz | 441/4 |
| 3,739,736 | 6/1973 | Carreau et al. | 114/293 |
| 3,913,157 | 10/1975 | Versluis et al. | 114/230 |
| 4,070,981 | 1/1978 | Guinn et al. | 114/293 |
| 4,434,741 | 3/1984 | Wright et al. | 114/264 |

FOREIGN PATENT DOCUMENTS

| | | | |
|---|---|---|---|
| 0195210 | 10/1985 | Japan | 114/230 |

OTHER PUBLICATIONS

Single Point Moorings by Roger Maari, President and CEO-Single Buoy Moorings, Inc. SBM Inc. Publication Copyright 1985 ISBN 2-9500554-0-0.

*Primary Examiner*—Edwin L. Swinehart
*Attorney, Agent, or Firm*—Michael E. Martin

[57] ABSTRACT

A single point submersible mooring buoy for use in ice infested and severe sea state anchorages for transferring fluids between marine tankers and fluid handling facilities includes a buoy body having a rotatable turntable disposed thereon for supporting a hose reel and a mooring hawser and associated winch. The buoy includes onboard anchor chain windlasses for maintaining anchor chain tension in the surfaced as well as submerged positions. Suitable ballast tanks, compressed air reservoirs, hydraulic pumps and motors are disposed on the buoy and may be operated by remote control to move the buoy between floating and submerged positions and to provide for connecting and disconnecting the fluid transfer hose and mooring hawser with respect to a vessel such as a tanker.

14 Claims, 3 Drawing Sheets

SUBMERSIBLE MOORING BUOY

BACKGROUND OF THE INVENTION

1. Field of the Invention

The present invention pertains to a submersible mooring buoy adapted for transferring fluids to or from tank ships at anchorages which are ice infested or are exposed to severe weather.

2. Background

The development of petroleum resources in arctic regions and other locations which require the transportation of petroleum liquids and liquefied natural gas by marine bulk carrier vessels or "tankers" often poses the difficulty of providing a suitable anchorage for these vessels during the loading and unloading procedure. In this regard, several types of so-called single point moorings have been developed which are generally characterized by a floating buoy structure which is anchored in waters of suitable depth to serve as a mooring for a tanker during transfer of fluids between the tanker and onshore or offshore facilities. Such buoys are usually fitted with suitable conduits, such as hoses or articulated pipes, which may be connected to the tanker to transfer the fluids.

Several types of buoys have been developed with design features being dependent on site conditions including water depth, normal operating sea states and survival wave heights. The type of fluid being transferred and the fluid transfer capacity also dictate mooring buoy features. Known types of mooring buoys include the so-called catenary anchor leg mooring (CALM) which comprises a buoy type floating structure which is anchored to the seabed by plural radially extending catenary chain legs. The tanker or similar vessel is moored to the buoy by one or more elastic mooring lines and floating or buoy mounted hoses extend between the buoy and a fluid transfer manifold on the ship. Single anchor leg moorings have also been developed wherein a buoy structure is connected to the seabed by a single anchor leg which may be a flexible chain or a tubular type riser structure. Suitable universal joints or swivel devices permit lateral, pitch and rotational excursion of the buoy with respect to a seabed anchor structure.

However, known types of mooring buoys for transferring fluids to or from tankers are not suitable for placement in anchorages located in seas which have severe ice conditions or extreme wave heights. In this regard, it has been deemed desirable to develop a mooring buoy which may be submerged when not in use to minimize stress and strain on the buoy from severe sea states and to minimize damage or prevent total loss of the buoy in anchorages which are subject to severe ice coverage and/or ice movement at various times.

Locations wherein it has been deemed desirable to provide a mooring buoy which may be submerged to a suitable depth to avoid ice coverage or movement during inactive periods include proposed anchorages at certain points in ice infested waters, including the Bering Sea and the Chukchi Sea, for example. Certain proposals are being considered for the production of natural gas reservoirs on the North Slope region of the State of Alaska. These proposals contemplate the transfer of natural gas in liquid form onto tankers at one or more selected anchorages in the Bering Sea or the Chukchi Sea. Close to shore anchorages in these waters would be rather shallow and subject to severe sea ice coverage and movement. It is in this regard that the present invention has been developed with a view to providing a mooring buoy which may be used to transfer fluids to or from a floating tanker and which then may be submerged during periods of non-use to avoid damage due to ice formation and movement and other severe sea conditions.

SUMMARY OF THE INVENTION

The present invention provides a unique mooring buoy for anchoring a vessel offshore in somewhat exposed and ice infested seas and which buoy may be submerged during periods of non-use to avoid stress and damage due to severe sea states and/or ice formation and movement.

In accordance with one aspect of the present invention, a submersible mooring buoy is provided which includes suitable fluid transfer conduits for transferring fluids between a tanker and a submarine pipeline.

In accordance with another important aspect of the invention, a mooring buoy is provided which includes on-board storage of ship mooring lines and fluid transfer conduits and which buoy is submersible to permit suitable safe storage of the buoy during periods of non-use.

In accordance with yet another aspect of the present invention, a submersible catenary anchor leg mooring buoy is provided which may be moved between a buoyant condition for serving as an anchor buoy for a ship and a submerged condition for storage of the buoy out of harm's way while maintaining the buoy suitably anchored to its chain legs.

In accordance with yet a further aspect of the present invention, a submersible mooring buoy is provided which includes on-board motors and pumps for effecting movement of the buoy between a floating condition on the sea surface and a submerged condition for storage of the buoy.

Those skilled in the art will further appreciate the above-noted features of the invention together with other superior aspects thereof upon reading the detailed description which follows in conjunction with the drawing.

DESCRIPTION OF PREFERRED EMBODIMENTS

Figure 1:
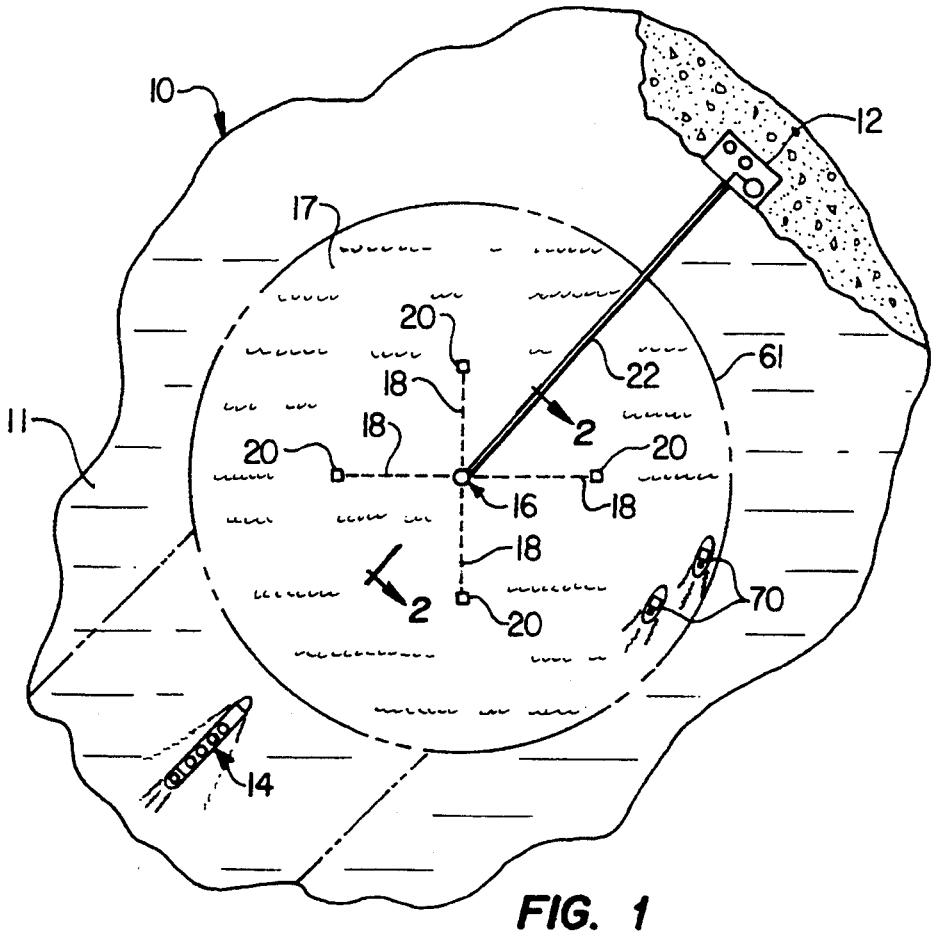
FIG. 1 is a plan view of an exposed anchorage showing a mooring buoy and a method of clearing ice in the vicinity thereof in accordance with the present invention.

In the description which follows, like parts are marked throughout the specification and drawing with the same reference numerals, respectively. The drawing figures are not necessarily to scale and certain features may be shown in somewhat generalized or schematic form in the interest of clarity and conciseness.

Referring to FIG. 1 there is illustrated a somewhat exposed anchorage 10 in an area which may be subject to severe ice accumulation and movement and/or severe sea states. For example, the anchorage 10 may be on the West or North Coast of Alaska, in the Bering Strait or the Chukchi Sea, for example. These seas are relatively shallow in near-shore areas and are subject to heavy ice coverage and movement. However, it may also be desirable to provide a marine terminal and anchorage in these areas for transferring petroleum fluids between an onshore storage and processing facility 12 and a transport vessel such as a liquefied natural gas (LNG) tanker 14. In this regard, it is proposed to provide a single point mooring buoy in accordance with the invention and generally designated by the numeral 16. The buoy 16 is anchored in the anchorage 10 by flexible catenary anchor legs comprising chains 18 arranged in a suitable pattern and each connected to a suitable seabed anchor 20. The anchors 20 may comprise piles driven into the seabed 23 or other suitable sea anchor means. The buoy 16 includes suitable fluid transfer conduits which will be described in further detail herein and which are connected to a pipeline 22 extending between the facility 12 and the buoy 16.

Figure 2:
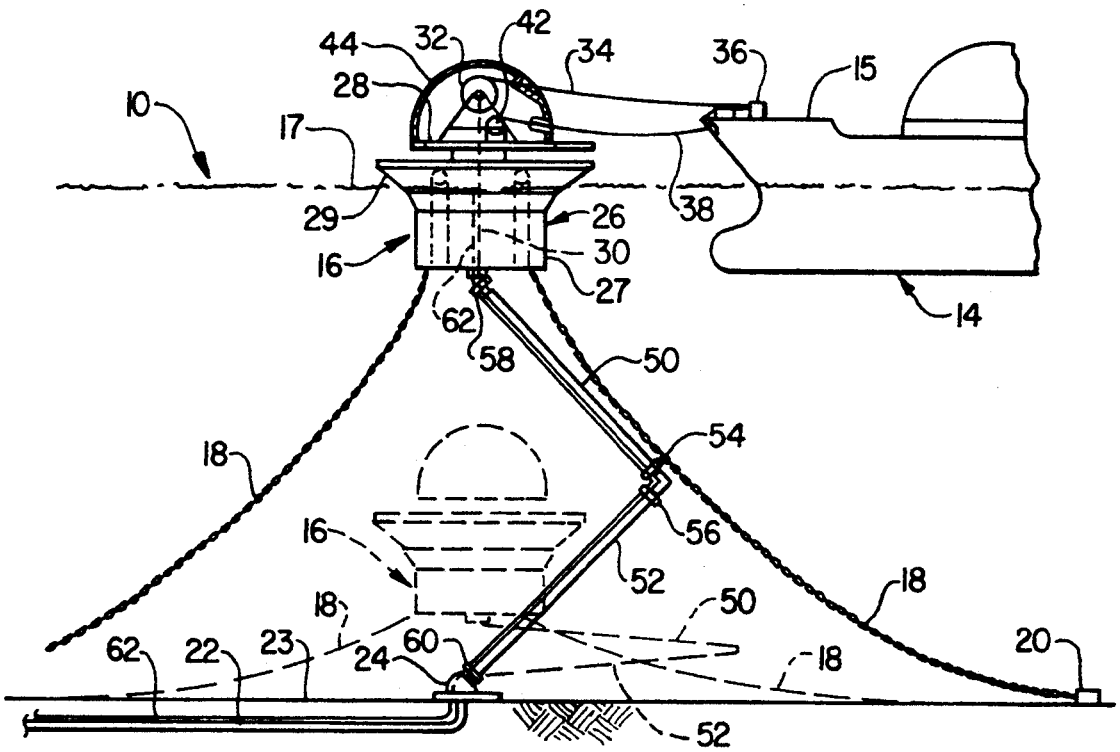
FIG. 2 is a view taken generally along the line 2—2 of FIG. 1 and showing the mooring buoy of the present invention connected to a liquefied natural gas (LNG) tanker.

As shown in FIG. 2 also, the pipeline 22 is preferably buried at least partially in the seabed 23 and is suitably connected to a seabed anchored fluid manifold 24. The pipeline 22 may also be disposed in a suitable tunnel, not shown, to facilitate periodic inspection of the pipeline, for example. In FIG. 2, the buoy 16 is shown in a position floating on the sea surface 17 and suitably connected to the tanker 14. The buoy 16 includes a body 26 which has a generally cylindrical bottom part 27 and a circumferential generally inverted cone shaped ice deflection skirt 29 extending radially outward from the cylindrical part. The ice deflection skirt 29 has a compound scope outer wall **29*a* and 29*b* for deflecting floating ice downward and around the body 26. The body 26 has controllable buoyancy, as will be described in further detail herein, and supports a turntable 28 for rotation relative to the body 26 about a central axis 30. The turntable 28 supports a hose reel 32 for a fluid conducting hose 34 which is shown extending between the buoy 16 and the tanker 14 and suitably connected to a fluid transfer manifold 36 on the tanker foredeck 15. The buoy 16 is also connected to the tanker 14 by a suitable flexible mooring hawser 38 which is partially wound on a suitable motor driven winch 42 mounted on the turntable 28. The hose reel 32 and the winch 42 may be disposed in a water tight, somewhat hemispherical enclosure 44. The enclosure 44 also forms an ice shield when the buoy 16 is moved from a submerged to a surfaced position and otherwise provides protection for the reel 32 and the winch 42**.

Fluid may be transferred between the hose 34 and the pipeline 22 by way of the manifold 24 and an articulated fluid conducting pipe including pipe sections 50 and 52 which are connected to each other by suitable flexible hose sections, not shown in FIG. 2, and associated universal joints 54 and 56. Still further, the pipe section 50 is connected to the buoy 16 at a suitable universal joint 58 and the pipe section 52 is connected to the manifold 24 by a similar universal joint 60. A suitable control cable 62 is trained along the pipeline 22, through the manifold 24 and along the pipe sections 50 and 52 to the buoy 16 for controlling operation of the buoy, which will be described in further detail.

FIG. 2 shows the buoy 16 in an alternate submerged position, as indicated by the dashed lines, when not in use and when severe sea state conditions, ice accumulation and ice movement are experienced in the anchorage 10. In this way, the buoy 16 may be protected against damage or destruction as a result of the severe ice conditions which, for example, exist in the Chukchi Sea and the Bering Sea throughout much of the year.

It is contemplated that the tanker 14 may approach the anchorage 10, as shown in FIG. 1, along a preferred course with respect to the buoy 16 during conditions when ice 11 exists on the sea surface 17. If it is desired to load or unload the tanker 14 using the buoy 16 when the sea is covered with ice 11, ice management would be carried out by providing an area of at least broken ice within a circle 61 having a radius of approximately 2000 feet to 3000 feet, for example. The circle 61 is traversed by one or more ice breaking motor vessels 70. Once a relatively clear area within circle 61 is obtained, the buoy 16 is moved from its submerged position to its floating position, shown in FIG. 2, so that the tanker 14 may approach the buoy and be suitably connected thereto to transfer fluids between the buoy and the cargo tanks of the vessel 14.

Once the fluid transfer operation is completed and the tanker 14 is disconnected from the buoy 16, it may be returned to its submerged condition shown in FIG. 2. Operation of the buoy 16 to move between a floating and submerged condition is carried out by a combined operation of flooding suitable ballast compartments within the buoy, to be described in further detail herein, and winching or paying out the chain legs 18 with respect to the buoy 16 by suitable windlasses to be described in detail herein and disposed onboard the buoy. Operation of the buoy 16 may be controlled from the onshore facility 12 through signals transmitted by way of the cable 62 or by radio control from the tanker 14, the ice breakers 70 or the onshore facility. Still further, at least some power requirements for certain equipment on the buoy 16 may also be transferred to the buoy by a suitable electrical power cable, not shown, associated with the signal conducting cable 62. The universal joints 54, 56, 58 and 60 may be of a type known to those skilled in the art and described in the publication entitled "Single Point Moorings", Roger Maari, SBM Inc., Monaco, 1985. Multiple fluid flowpaths may be provided through the universal joints and the manifold 24 as also described in the above-referenced publication.

Figure 3:
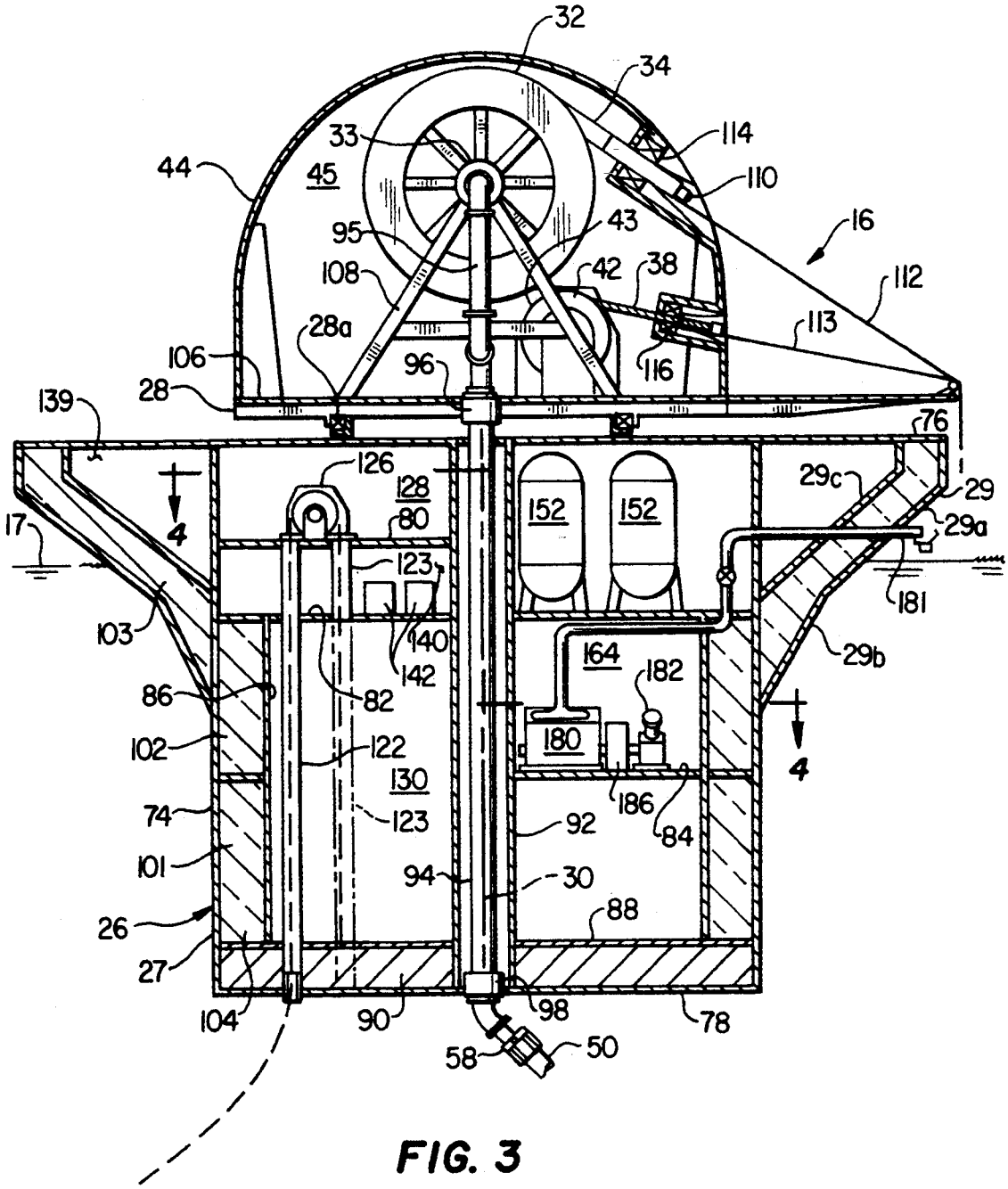
FIG. 3 is a vertical section view of the mooring buoy taken generally along the line 3—3 of FIG. 4.
Figure 4:
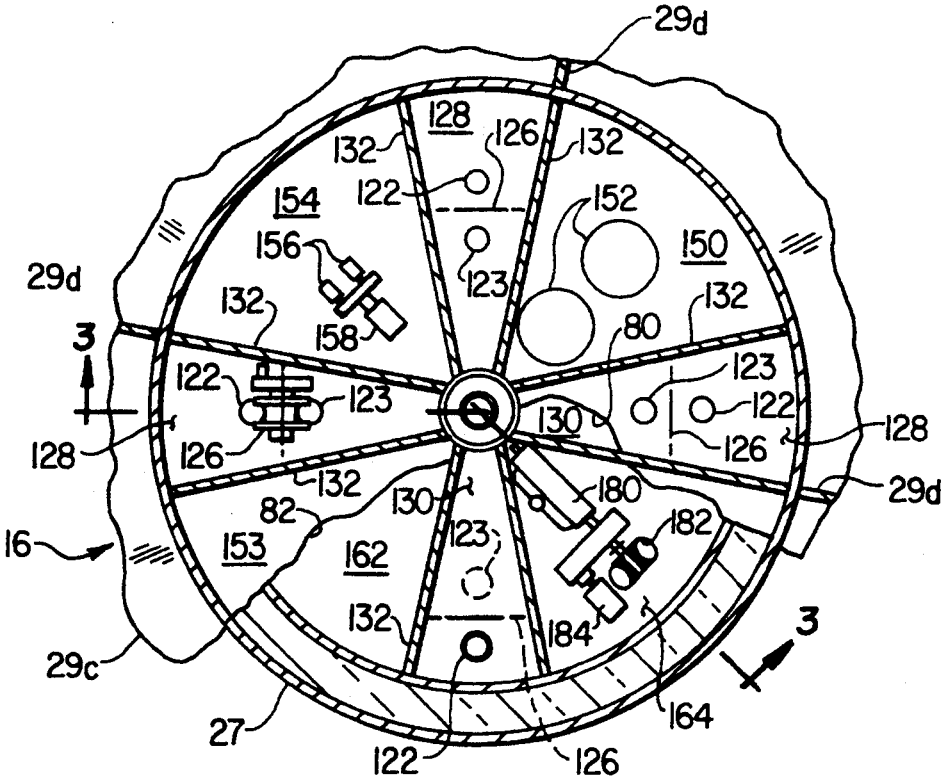
FIG. 4 is a section view taken generally along the line 4—4 of FIG. 3.

Referring now to FIGS. 3 and 4, certain features of the mooring buoy 16 are illustrated. The buoy body 26 is characterized by the generally cylindrical bottom part 27 having a cylindrical outer hull 74 and a transverse bottom wall 78. The buoy body 26 may be divided into several interior compartments by plural, transverse, spaced apart decks 80, 82 and 84, an inner cylindrical hull 86 and an inner bottom wall 88. A space between the bottom wall 78 and the inner bottom wall 88 may be filled with permanent ballast material 90. A coaxial, cylindrical casing 92 provides a passage for a fluid conducting pipe 94 extending between spaced apart fluid transfer swivels 96 and 98. Annular spaces between the outer hull 74 and the inner hull 86 and within the skirt 29 form plural annular buoyancy chambers 101, 102 and 103 which may be filled with a suitable styrene or polyurethane foam flotation material 104.

As shown in FIG. 3, the turntable 28 is mounted on a suitable bearing 28*a* for rotation of the turntable about the central axis 30 of the buoy body 26. The turntable 28 includes a transverse deck 106 on which is supported the hose reel 32 by suitable spaced apart A-frame type supports 108, one shown in FIG. 3. The hose reel 32 includes a suitable hub part 33 which is in fluid flow communication with one end of the hose 34 and with fluid conducting pipe 95 connected to the swivel 96. The distal end of the hose 34 includes a suitable probe member 110 which may be stabbed into the probe-receiving manifold 36 on the tanker 14. A messenger line 112 is connected to the distal end of the hose 34 for hauling the hose aboard the tanker 14 in a conventional manner. The interior space 45 defined by the enclosure 44 and the deck 106 is maintained substantially water tight by suitable annular seals 114 and 116 which are engageable with the fluid transfer hose 34 and the mooring hawser 38. The hawser 38 is also connected to a suitable messenger line 113 which, together with the messenger line 112 may be handed over to the crew of the tanker 14 in a conventional manner upon approach of the tanker to the buoy. The hawser winch 42 may be operated by suitable motor means 43.

As shown in FIGS. 3 and 4, each of the anchor chains 18 is adapted to be trained through a suitable fair-lead 120, a haws pipe 122 extending up through the decks 82 and 80 and through a power operated anchor windlass 126 disposed on the deck 80. The windlass 126 is disposed in a suitable compartment 128 defined in part by the decks 76 and 80, the casing 92 and the inner hull member 86. As shown in FIG. 4, a plurality of windlass compartments 128 are provided for disposition of the power operated windlasses 126 which are connected to respective ones of the four anchor chains 18.

The anchor chains 18 are each trained over the windlasses 126 and through guide pipes 123 down into respective chain lockers 130. The windlass compartments 128 and chain lockers 130 are also defined by vertically extending partition members 132, exemplary ones of which are marked in FIG. 4. The windlass compartments 128 may be suitably pressurized with pressure air to prevent incursion of water thereinto through the haws pipes 122 even when the buoy 16 is in its submerged condition. The chain lockers 130 may or may not be floatable. Alternatively, the guide pipes 123 may be extended through the bottom wall 78 whereby the chains 18 may hang toward the seabed 23.

A circumferential watertight space 139 is provided between the skirt inner wall 29*c*, the hull 74 and the deck 76. The space 139 may be subdivided by radially extending spaced apart bulkheads 29*d*, FIG. 4. Watertight compartments 140 are also provided between decks 80 and 82 and between each set of partitions or bulkheads 132 which define the windlass compartments 128. One of these compartments 140 is shown in FIG. 3 and may provide space for suitable electrical storage batteries 142, for example. Plural watertight compartments are also provided between the decks 76 and 82 and between the windlass compartments 128, as shown in FIG. 4. One of these compartments, designated by the numeral 150, may provide storage space for one or more compressed air reservoirs 152, for example. Yet another of the compartments defined above is designated by the numeral 154 and may comprise a machinery space for plural hydraulic pumps 156 which are suitably driven by an electric motor 158. Third and fourth compartments 153, one shown in FIG. 4, on the level between the deck 82 and the deck 76 may serve as floatable ballast tanks or may be adapted to comprise machinery spaces for location of other machinery and/or controls.

Figure 5:
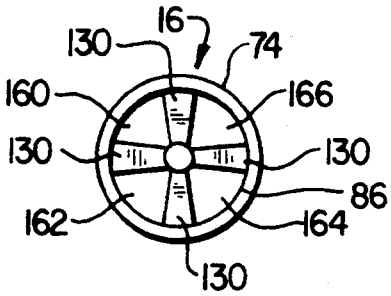
FIGS. 5 and 6 are schematic views showing one preferred arrangement of compartments within the buoy illustrated in FIGS. 3 and 4.
Figure 6:
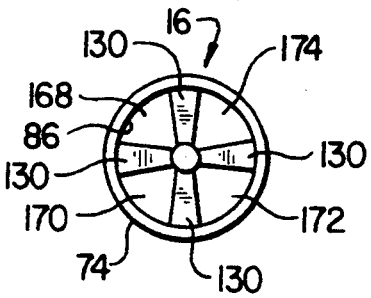

By way of example only, plural compartments are formed between decks 82 and 84, as shown in FIG. 5 designated by the numerals 160, 162, 164 and 166, and are interposed between the respective chain lockers 130. Still further, compartments may be formed between the deck 84 and the inner bottom wall 88, as shown in FIG. 6 and designated by the numerals 168, 170, 172 and 174.

By way of example only, FIGS. 3 and 4 show compartment 164 formed as a machinery space for the location of an internal combustion engine 180 adapted to drive an air compressor 182 and an electrical generator 184, FIG. 4, through suitable drive means 186. Combustion air may be drawn into the engine 180 via a snorkel 181 and exhaust gases may be vented above or below the surface 17. This machinery may also be disposed on the level of deck 82 in one of the aforementioned compartments 153. The placement of machinery in the illustration of FIGS. 3 and 4 is not intended to show the actual placement in a working buoy when buoyancy and stability considerations are taken into account. The location of the reservoirs 152, the hydraulic pumps 156 and the machinery in the compartment 164 may be changed to other spaces or compartments within the buoy body 26 when stability considerations are addressed. Moreover, the illustrations of FIGS. 3 and 4 are intended to be exemplary in that certain components are illustrated as being rotated into the plane of the drawing when they may be more desirably located at other positions with respect to the central axis 30. At least the compartments 168, 170, 172 and 174 may be flooded to substantially decrease the buoyancy of the buoy 16 whereby the buoy may be winched into its submerged position by the anchor windlasses 126. As the windlasses 126 winch anchor chain 18 into the lockers 130, the buoyancy of the buoy 16 will decrease as the dead weight load of the anchor chains increase to assist in moving the buoy to its submerged position. Alternatively, if the chains 18 are dropped through the extended guide pipes 123 to the seabed 23 a different buoyancy change will occur as the buoy 16 approaches the seabed.

As previously described, when it is desired to anchor a ship such as the tanker 14 to the buoy 16, if the buoy is in a submerged condition as shown by the alternate position in FIG. 2, the buoy would be remotely controlled to release compressed air from the reservoirs 152 into the ballast tanks 168, 170, 172 and 174, for example, to displace water from these tanks to increase buoyancy. Concomitantly, the windlasses 126 would be operated to set a certain amount of drag to stabilize the buoy 16 while allowing it to rise to the surface still connected to the fluid conduit system characterized by the pipe sections 50 and 52 and the associated universal or Cardan joints previously described.

Upon reaching the sea surface and the working position shown in FIGS. 2 and 3, the messenger lines 112 and 113 would be suitably retrieved and made accessible to the crew of the tanker 14 for hauling onboard and for use in retrieving the mooring hawser 38 followed by retrieving the hose 34 for connection to the manifold 36. Once mooring had been completed and the hose 34 suitably connected to the loading and/or unloading manifold 36, fluids such as LNG may be transferred between the tanker 14 and the shore-based facility 12 by way of the hose 34, the piping 95 and 96 inclusive of the fluid swivels 96 and 98, the articulated pipe or conduit assembly comprising the pipe sections 50 and 52 and the universal joints 54, 56, 58 and 60, the manifold 24 and the pipeline 22. During loading or unloading, the engine 180 may be operated to drive the compressor 182 and the generator 184 to replenish the compressed air reservoirs 152 and to provide suitable power to the buoy 16, as needed, as well as to recharge storage batteries 142, if used. Alternatively, all electrical power for operating the motor 158 and power for driving the compressor 182 might be supplied from the shore facility 12 by way of a suitable power cable as aforementioned.

During operation of the buoy 16 while on the surface in the position shown in FIGS. 2 and 3, the buoy may respond to wave action by limited vertical, lateral and rotative motion thanks to the catenary anchor legs provided by the chains 18, the swivel 98 and the universal joints 54, 56, 58 and 60 without affecting operation of the buoy.

When it is desired to disconnect the tanker 14 from the buoy 16, the hawser 38 and hose 34 are dropped from the ship and retrieved onto their respective storage drum and reel by remote-control operation of the winch 42 and a suitable motor, not shown, driving the hose reel 32. At least the ballast tanks or compartments 168, 170, 172 and 174 are then flooded to reduce the buoyancy of the buoy 16 while the windlasses 126 are operated to winch the buoy down to the alternate position illustrated in FIG. 2. The windlasses 126 are preferably controlled to maintain a predetermined tension on the chains 18 to stabilize the buoy 16 during movement between surfaced and submerged positions. Suitable controls, not shown, may be operated to control the flooding of the tanks or compartments 168, 170, 172 and 174 as well as additional ballast tanks 160, 162 and 166, if needed, to control the buoyancy and stability of the buoy 16 as it moves between a working position on the surface 17 and the submerged position. The compartments 45 and 128 are also suitably pressurized to maintain these compartments watertight in the submerged condition.

The buoy 16 may be designed in detail in accordance with the principles of naval architecture and constructed of conventional materials and components used for marine vessels and structures operating in harsh climates and salt water. If the piping system for delivering fluids to and from the buoy 16 is adapted for conducting LNG, it may be necessary to provide suitable insulation and/or heating elements around the pipe sections 50 and 52 and the associated universal joints to prevent the accumulation of ice due to the extreme low temperature of the fluids being conducted therethrough. Certain details of the buoy 16, such as hatches to provide access to the machinery spaces, valving and controls for flooding and deballasting the buoy and controls for operating the windlasses 126, the hose reel 32 and the winch 42 are believed to be attainable by the art worker.

Although a preferred embodiment of a submersible mooring buoy has been described herein in some detail, those skilled in the art will recognize that certain substitutions may be made to the embodiment described without departing from the scope and spirit of the appended claims.

What is claimed is:

1. A submersible buoy for use at an anchorage for anchoring a ship to provide for transfer of fluids between said ship and a fluid handling facility, said submersible buoy comprising:

a body having at least one ballast tank disposed therein and operable to be flooded with sea water to at least assist in submerging said buoy, anchor means for anchoring said buoy at said anchorage, a fluid transfer conduit disposed on said buoy at said anchorage, a fluid transfer conduit disposed on said buoy and adapted to be connected to a ship for transferring fluids between said ship and said buoy, means for storing said fluid transfer conduit on said buoy and means for mooring said ship to said buoy;

a turntable mounted on said body and adapted to pivot with respect to said body, said means for storing said fluid transfer conduit being disposed on said turntable, and said means for mooring said ship to said buoy comprising a winch disposed on said turntable and a flexible hawser operable to be dereeled from said winch and connected to said ship for mooring said ship to said buoy; and an enclosure disposed on said turntable and forming a substantially water-tight space for said means for storing said conduit and said winch.

2. The buoy set forth in claim 1 wherein:

said anchor means comprises plural flexible chains each connected at one end to anchor means on the seabed and connected at its opposite end to a windlass disposed on said buoy, said windlass being operable to maintain a predetermined tension on said chain.

3. The buoy set forth in claim 2 including:

a chain locker operable to store accumulated portions of said anchor chain on said buoy when said buoy is moved from a surfaced position to a submerged position.

4. The buoy set forth in claim 2 wherein:

said body includes a guide pipe for guiding portions of said chain reeled by said windlass to fall toward said seabed.

5. The buoy set forth in claim 1 wherein:

said body comprises a generally cylindrical hull part.

6. The buoy set forth in claim 1 wherein:

said body includes an ice deflection skirt formed thereon for deflecting floating ice away from said buoy.

7. The buoy set forth in claim 1 wherein:

said fluid transfer conduit includes an articulated conduit connecting said buoy to a manifold disposed on the seabed.

8. The buoy set forth in claim 7 wherein:

said articulated conduit comprises at least two pipe sections interconnected by universal joint means and said pipe sections are connected to said buoy and to said manifold by universal joint means, respectively.

9. The buoy set forth in claim 8 wherein:

said articulated conduit is connected to a fluid conducting conduit on said body by a fluid conducting swivel on said buoy.

10. The buoy set forth in claim 5 wherein:

said body includes an annular buoyancy tank disposed thereon and defined in part by an outer wall of said hull part.

11. The buoy set forth in claim 10 including:

permanent ballast means disposed on said body.

12. The buoy set forth in claim 1 wherein:

said anchor means comprises a plurality of anchor windlasses disposed thereon and each connected to an anchor chain for securing said buoy in a predetermined position on the surface of the sea and in a predetermined position submerged below the surface of the sea.

13. The buoy set forth in claim 12 wherein:

each of said windlasses is disposed in a compartment operable to be pressurized by pressure air in a submerged condition of said buoy.

14. A submersible mooring buoy for mooring a marine tanker and for transferring fluids between said tanker and a fluid handling facility, comprising:

a buoy having at least one floatable ballast compartment operable to be flooded with sea water to at least assist in submerging said buoy;

a plurality of catenary anchor chains extending between said body and plural chain anchors on a seabed;

plural windlasses on said body connected to respective ones of said chains and operable to reel said chains in and pay said chains out with respect to said body when said buoy is moved between submerged and floating positions in the sea;

a conduit connected to said buoy and to a manifold on the seabed; and conduit means on said buoy and operable to be connected to said tanker for transferring fluids therebetween, said conduit means on said buoy comprising flexible hose disposed on a reel on said buoy, said reel being disposed in a watertight enclosure for shielding said hose from ice in the sea. enclosure for shielding said hose from ice in the sea.

* * * * *